United States Patent [19]

Harbst et al.

[11] Patent Number: 4,480,565

[45] Date of Patent: Nov. 6, 1984

[54] SEWING MACHINE NEEDLE COOLER

[75] Inventors: John W. Harbst, Hoffman Estates; James A. Frendreis, Morton Grove, both of Ill.

[73] Assignee: Union Special Corporation, Chicago, Ill.

[21] Appl. No.: 318,703

[22] Filed: Nov. 6, 1981

[51] Int. Cl.[3] ..... D05B 71/04

[52] U.S. Cl. ..... 112/281

[58] Field of Search ..... 112/281; 34/20; 15/339, 15/316 R, 405; 239/587, 588

[56] References Cited

U.S. PATENT DOCUMENTS

| | | | |
|---|---|---|---|
| 2,080,322 | 5/1937 | Vesconte | 112/281 |
| 2,457,362 | 12/1948 | Giglio . | |
| 2,593,203 | 4/1952 | Schwartz | 112/281 |
| 2,690,147 | 9/1954 | Adams . | |
| 2,690,148 | 9/1954 | Adams . | |
| 2,690,149 | 9/1954 | Adams . | |
| 3,721,204 | 3/1973 | Schaffer et al. | 112/281 |
| 3,910,210 | 10/1975 | Marforio | 112/281 |
| 3,985,302 | 10/1976 | Frochaux | 239/587 |
| 4,193,364 | 3/1980 | Dunne . | |
| 4,305,339 | 12/1981 | Inglis | 112/281 |

FOREIGN PATENT DOCUMENTS

| | | | |
|---|---|---|---|
| 802448 | 10/1958 | United Kingdom | 239/587 |

*Primary Examiner*—Henry S. Jaudon
*Assistant Examiner*—Andrew M. Falik
*Attorney, Agent, or Firm*—John W. Harbst; John A. Schaerli

[57] ABSTRACT

A needle cooling apparatus including a nozzle assembly maneuverable between operative and inoperative positions. In its operative position, the nozzle assembly is adapted to direct a cooling medium against the sewing machine needles. The nozzle assembly is operatively associated with a drive adapted to arrange and biasably maintain the nozzle assembly in its operative position in response to machine actuation.

21 Claims, 5 Drawing Figures

SEWING MACHINE NEEDLE COOLER

FIELD OF THE INVENTION

The present invention relates to sewing machines and more particularly to an apparatus for cooling the sewing machine needle means.

BACKGROUND OF THE INVENTION

Incident to the high speed operation of machines of the kind referred to, considerable heat is generated by the reciprocation of sewing machine needles through a workpiece. The excessive heat of the needle, especially when sewing synthetic fabrics, may cause either melting of the fabric workpiece or the breaking of the thread passing through the needle eye. This condition is aggravated by the limited space requirements provided for placing a needle cooler relative to the needle but yet allowing operator access to the sewing area.

The purpose of this invention is to obviate these problems and to obtain greater efficiency and economy in operation of such machine. This purpose is accomplished by the provision of a pneumatically actuated mechanism operable, incident to machine operation, to biasably maneuver a needle cooling apparatus between an operative position, whereat a nozzle may be arranged closely adjacent the sewing machine needles to disperse a cooling medium thereagainst, and an inoperative position. In its inoperative position, the needle cooler is removed from the zone of the needles whereby providing operator access to the sewing area. The needle cooler is biased into its operative position under a constant but yielding pressure such that, if necessary, the nozzle may be temporarily displaced from the sewing area or zone but is then automatically returned to its operative position. A positive stop incorporated into the design of the needle cooler assures constant and proper positioning of the nozzles relative to the sewing machine needles. Because the present invention is activated incident to machine operation, the machine operator need not be concerned whether the needle cooler has been activated. In addition, means may be provided to automatically retract the needle cooler from its operative position upon completion of the sewing operation whereby allowing operator access to the machine.

In one form of the device, the needle cooler may include a distendable arm which carries the cooling nozzles toward the sewing zone of the machine. In its distended position, the arm may be arranged such that it extends proximate to and crosswise of the reciprocal path of the needles.

In line with all of the above, it is a primary object of this invention to provide a sewing machine needle cooler which, incident to machine operation, is maneuverable between a first disposition whereat a cooling medium is discharged against the sewing machine needles, and a second disposition, the latter position allowing operator access to the sewing area.

Another object of this invention is the provision of a needle cooler which is readily adapted to a wide range of machines, is inexpensive and economical in its operation.

A further object of this invention is to provide means operative to maintain the sewing machine needle cool while operating but which provides operator access to the sewing area when the machine is inoperative.

Another object of the invention is to provide a sewing machine needle cooling device which may be detachably secured to the sewing machine without significant alteration or modification of the machine itself.

It is a further object of this invention to provide a needle cooler which is biased into an operative position by a pneumatic system which allows the needle cooler to be temporarily displaced from its operative position and automatically returned thereto during the sewing operation.

Other objects and a fuller understanding of the invention may be had by referring to the following disclosure and claims, taken in conjunction with the accompanying drawings in which:

DETAILED DESCRIPTION OF A PRESENTLY PREFERRED EMBODIMENT

Figure 2:
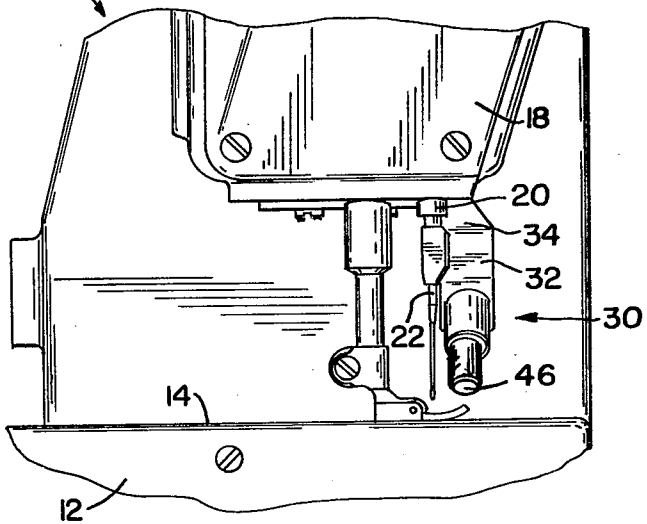
FIG. 2 is a fragmentary side elevational view of the machine illustrated in FIG. 1.

Referring now to the drawings, wherein like reference numerals indicate like parts throughout the several views, there is shown a portion of a sewing machine 10. The machine 10 may be of any suitable character intended or adapted for operation at such speeds or under such conditions as to make cooling of the sewing needles either necessary or desirable. Suffice it to say, the machine illustrated includes a frame comprising a base 12 with a work supporting surface 14 and an arm 16 terminating in a head 18 overhanging the base 12. The machine is provided with the usual sewing devices including a presser bar, a presser foot, needle bar means and etc. The needle bar 20 is mounted in the head for vertical, endwise reciprocation and at its lower end carries one or more needle means 22 defining a sewing area or zone. The needle means are adapted to cooperate, in a well known manner, with complimentary lower stitch forming means (not shown) arranged beneath the work supporting surface, thus producing a seam or a plurality of lines of stitching of appropriate character. Since the sewing machine proper is of conventional form, it need not be described in further detail.

Figure 4:
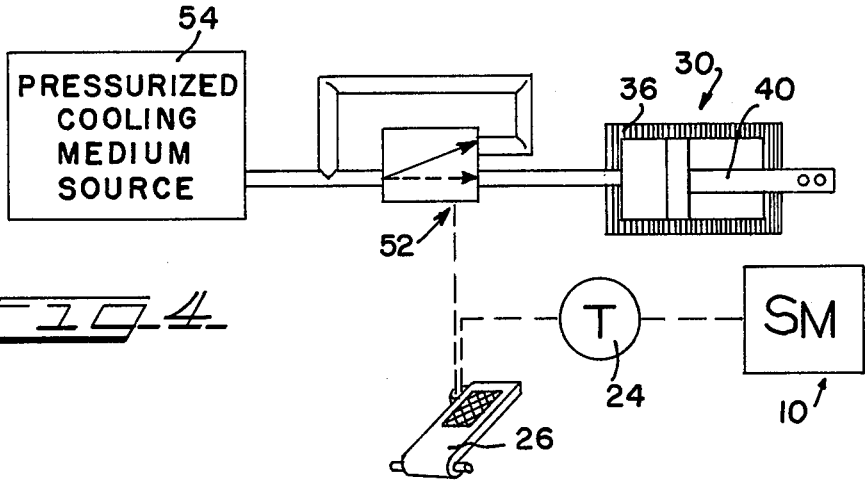
FIG. 4 is a schematic illustration of a pneumatic system comprising a portion of the present invention.

As schematically represented in FIG. 4, power for driving the machine 10 is supplied by means of a driving motor or transmitter 24. The transmitter unit is operatively connected to the machine and may be operated, at will, by an operator controlled treadle 26. This construction is such that the machine may be intermittently operated simply by rocking the foot treadle 26 whereby actuating the motor and thereby the machine.

Figure 1:
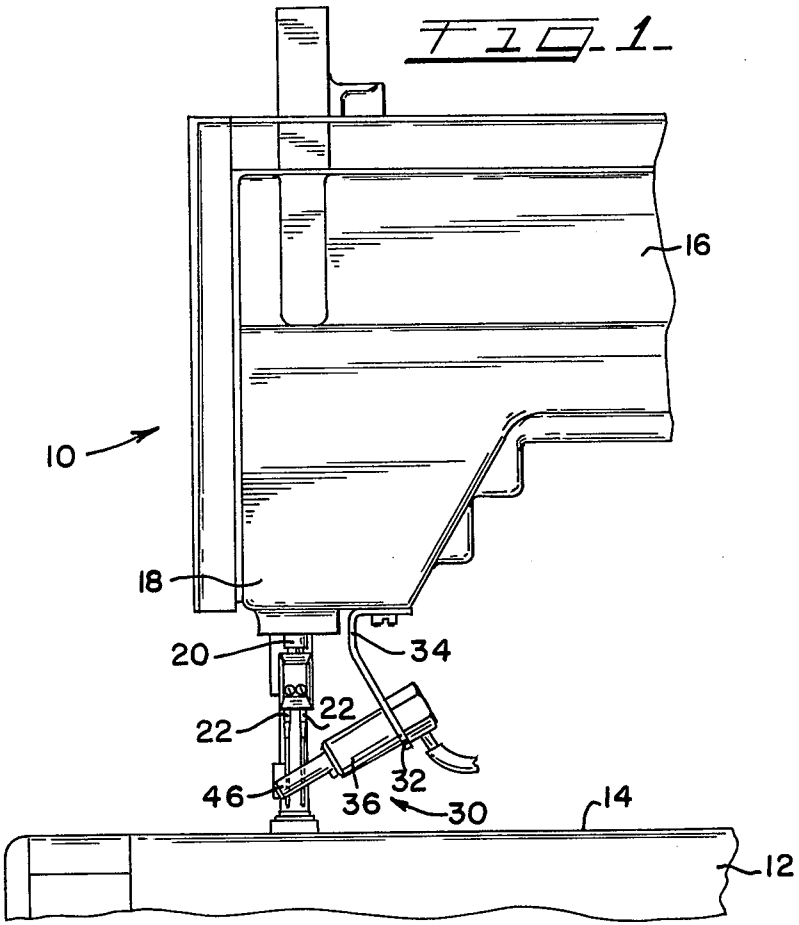
FIG. 1 is a fragmentary front elevational view of a portion of a sewing machine embodying the invention.
Figure 3:
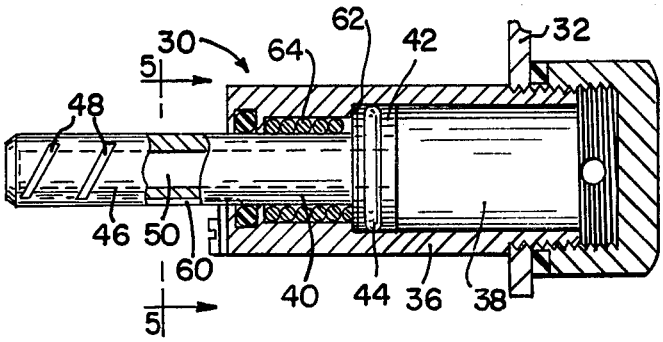
FIG. 3 is a sectional view of a presently preferred form of a needle cooling device.

The novel needle cooler of the present invention, generally designated as 30, is shown in FIGS. 1 and 2 as attached to a depending arm 32 of a bracket 34 which, in turn, is detachably secured to the head 18 of the machine. By such construction, the needle cooler is independently mounted of any sewing machine movable part whereby eliminating any inertia effect. As shown additionally in FIG. 3, the needle cooler 30 is a fluidically actuated, maneuverable device that is operative incident to the actuation of the machine and is adapted for movement between two dispositions. In one presently preferred form, the needle cooler 30 includes an open ended housing 36 that may be detachably secured to the bracket arm 32. The housing 36 may be cylindrical in shape and has an internal cylindrical piston chamber 38. Telescopically disposed within the piston chamber in a maneuverable manner permitting bodily shifting thereof, is a pneumatically responsive component or piston member 40. The piston member includes a piston head 42 including a sealing means 44 and a stem or conduit portion 46 which, when axially extended, protrudes beyond the housing 36. At its distal end, the piston member 40 is provided with nozzle or exhaust port means 48. The exhaust port means communicate with a longitudinal bore 50 provided in and extending substanially the length of the piston member 40. The exhaust port means 48 correspond in number to the needle means 22.

Turning to FIG. 4, for distending the piston member or conduit means into its operative position (shown in FIG. 3) thereby situating the nozzle means to cool the needles, the needle cooler is connected to a valve unit 52. The unit 52 is connected to a pressurized source of cooling medium 54 and includes a valve that will expose a pressurized cooling medium to the rearward side of the piston when the valve is actuated whereby effecting its movement. In the preferred form, the pressure cooling medium is air but other fluidic means could be used without distracting from the spirit and scope of the present invention. As will be appreciated, when in its operative position, the stem portion 46 of the piston member or conduit 40 is positionally distended into the zone of the sewing area such that the cooling medium discharged from the nozzle means is directed against the needle whereby cooling same.

Figure 5:
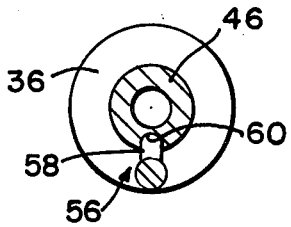
FIG. 5 is a end view of the needle cooler taken along line 5—5 of FIG. 3.

As shown in FIG. 5, for guiding the piston member whereby assuring a proper relationship between the nozzle means and the needles, a guide means 56 is provided. In its preferred form, the guide means includes a guide finger 58 which is secured to the housing 36 and which cooperates with a channel 60 provided along the periphery of the piston's stem portion 46 to prevent the piston from turning.

The maneuverable needle cooler of this invention is further provided with a positive stop to assure proper positioning of the nozzle means with respect to the sewing machine needles. Because the preferred form of the present invention includes an axially distendable piston, the means for assuring proper positioning of the nozzles relative to the needles includes a step 62 provided in the cylindrical chamber 38 of the housing 36 and which cooperates with the piston head 42. By this construction, the position of the step 62 limits the telescopic movement of the piston member 40 toward the zone of the needles. Accordingly, the nozzle or exhaust port means 48 are accurately positioned relative to the needles under the influence of the pressurized cooling medium.

Turning again to FIGS. 1 and 2, the movement of the piston member 40 has a horizontal component. In its fully distended position the stem portion 46 of the piston member 40 extends proximate to and crosswise of the reciprocal path of the sewing machine needle means. Also, because the piston member is yieldably biased into its operative position, it may be temporarily retracted and then, because of the constant pressure being applied by the pressurized cooling medium, automatically returned to its operative position. Upon completion of the sewing operation, the pressure to the piston member is relieved and the piston may be retracted to its nonoperative position whereby yielding access to the sewing area.

Means for automatically retracting the needle cooler upon cessation of the sewing operation may also be provided. To accomplish this purpose, and as may be best seen in FIG. 3, a compression spring 64 acting in opposition to the force created by the pressurized cooling medium and disposed between the piston head 42 and the housing 36 may be provided. In this manner, when the pressure in the housing chamber 38 decreases, at the completion of the sewing operation, the spring 64 may forcibly return the piston member 40 to its nonoperative position whereby removing the nozzle means 48 from the area proximate the needles.

Prior to operation of the machine, the needle cooling means may be arranged in a nonoperative position to allow operator access to the sewing area. Incident to the operation of the machine, the valve unit 52 is actuated by the operator's action on the treadle 26. As a result, the fluid pressure controlled mechanism of the present invention is activated to maneuver the nozzle means from an inoperative position to an operative position whereat they are in position to cool the needles. It is also conceivable to pneumatically operate the needle cooling means independent of the machine operation without stealing from the intended spirit and scope of this invention. Actuation of the valve 52 allows the pressurized cooling medium to pass into the piston chamber rearwardly of the piston head 42 whereby forcibly distending the stem portion 46 of the piston 40 into its operative position whereat it is positively stopped. By means of the longitudinal conduit 50, the pressurized cooling medium is delivered to the nozzle means 48 and ultimately dispersed against the needles 22 in a direction generally transverse or diverse to the direction of movement of the stem portion. The conduit or piston 40 remains distended under this biasable force but, with sufficient pressure in the opposite direction, is displaceable. Once the opposing force is removed, the nozzle means are automatically maneuvered or returned to their original position under the influence of the pressurized cooling medium. The influence against the piston member is released by the deactuation of the valve 52 which closes the supply of pressurized cooling medium to the piston chamber. As descibed, return of the needle cooler to an inoperative position may be effected under the influence of the spring 64 whereby the nozzle means are automatically removed from the sewing area thus providing operator access to the sewing area or zone.

Thus there has been provided, in accordance with the invention, a Sewing Machine Needle Cooler that fully satisfies the objects, aims, and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

Having adequately described the present invention, what we claim is:

1. A device for cooling the reciprocal needle of a sewing machine comprising:

a fluid pressure operated device including operative means for directing a cooling medium from said device toward the needle, said device being arranged on said machine with said operative means being independently mounted proximate said needle and maneuverable along a generally horizontal path between a generally static operative position whereat the cooling medium is continually directed toward the sewing machine needle in a direction generally transverse to the path of said operative means, and an inoperative needle cooling position.

2. A device for cooling the reciprocal needle of a sewing machine comprising:

nozzle assembly means independently operated and mounted of any sewing machine moving part and movable into positional arrangement relative to the reciprocal needle upon machine actuation, said nozzle assembly means effecting a controlled and continuous flow of cooling medium toward said sewing machine needle in a direction generally transverse to the direction of movement of said nozzle means during operation of the machine.

3. A sewing machine with sewing devices including endwise reciprocal needle means and an apparatus for cooling said needle means comprising:

biasable needle cooling means arranged proximate said needle means including operative means for directing a flow of cooling medium toward the needle means in a first direction, said operative means being independently mounted relative to the sewing devices and normally retained in a first inert position as a result of machine actuation and whereat said operative means is capable of providing a cooling effect on said needle means but which is movable in a second direction to a second position whereat the operative means has no operative effect on said needle means, with said first and second directions extending diverse relative to one another.

4. An apparatus capable of cooling the needle of a sewing machine comprising:

fluid pressure controlled mechanism operable independent of any sewing machine movable assembly for biasably and automatically controlling a nozzle means disposition along an extended path between operative and nonoperative positions as a function of the actuation of the machine, said nozzle means being adapted to direct a cooling medium flow toward said sewing machine needle in a direction transverse to the nozzle means path of movement while in said operative position.

5. The invention according to claim 4 wherein said fluid pressure controlled mechanism effectively maintains said nozzle means in said operative position while said sewing machine is operative.

6. An apparatus capable of cooling the reciprocal needle means of a sewing machine having a reciprocal needle bar for carrying said needle means and a frame, said apparatus comprising:

housing means seperate from but secured to said sewing machine frame; and extendable air nozzle means distendably carried by said housing means in a manner permitting bodily shifting thereof relative to said housing to a position whereat the nozzle means direct a flow of cooling medium toward the needle means in a direction transverse to the path of movement of said nozzle means, the operation and positioning of said air nozzle means being automatically controlled as a function of machine operation but independent of needle bar reciprocation.

7. An apparatus for cooling the needle means of a sewing machine comprising:

a housing having a pressure chamber;

piston means arranged for reciprocal movement within said pressure chamber, said piston means having a distal end extending beyond said chamber and a bore extending longitudinally thereof with exhaust port means in communication with said bore, said exhaust port means being arranged to exhaust a flow of cooling medium toward said needle means in a direction extending transverse to the longitudinal bore;

a pressurized source of cooling medium arranged independent of any sewing machine part and connected to said housing for communication with said exhaust port means; and operator controlled means capable of influencing the pressure created within said chamber by said cooling medium whereby controlling the position of said piston means.

8. An apparatus for cooling the reciprocal needle means of a sewing machine comprising:

a tubular sleeve mounted in a fixed position on a head of the sewing machine, one end of said sleeve being adapted for communication with a pressurized independent source of cooling medium;

a piston member mounted for endwise reciprocation in the sleeve and having a stem portion extending from the other end of said tubular sleeve, said piston member being provided with discharge port means adapted for communication with the pressurized source of cooling medium and directed at the needle means for exhausting a continuous flow of cooling medium in a direction transverse to the reciprocal path of said piston toward the needle means during a sewing operation; and operator controlled valve means for causing relative movement between the piston member and the needle means as a function of machine operation.

9. The invention according to claim 8 wherein the discharge port means correspond in a number to the needle means.

10. The invention according to claim 8 wherein the reciprocal movement of the piston member has a horizontal component extending proximate to and crosswise of the reciprocal path of the sewing machine needle means.

11. In a sewing machine having a needle bar adapted for endwise reciprocation, a needle disposed at the distal end of said needle bar, and means for cooling said needle comprising:

means operable independent of said needle bar reciprocation and other movable sewing mechanisms but operable incident to machine actuation for positionally disposing pneumatic nozzle means relative to the needle along a path between operative and nonoperative positions, said nozzle means being provided with discharge means for directing a continual flow of cooling medium toward said needle means in a direction transverse to the path of said means operable when said means operable move said nozzle means into operative position.

12. A sewing machine having a frame, needle means adapted for endwise reciprocation during a sewing operation and means for cooling said needle means comprising:

a houisng seperate from but securable to the machine frame and adapted for connection to a pressurized source of cooling medium independent of the sewing mcahine;

an endwise reciprocal elongated member which extends from the housing and is supported thereby having a conduit adapted to provide communication between the pressurized source of cooling medium and a discharge port, said member being movably influenced by the pressure of said cooling medium into a first position whereat aaid discharge port is positioned to effect a flow of cooling medium in a direction generally transverse to the reciprocal movement of said elongated member and toward said needle means; and means effective upon cessation of the sewing operation for urging said elongated member into a second position whereat said discharge port is removed from the area of said needle means.

13. The invention according to claim 12 wherein the urging means effective upon cessation of the sewing operation includes a spring.

14. A device for cooling the reciprocal needle means of a sewing machine comprising:

extendable/retractable nozzle means independently mounted and operated of any sewing machine moving part, said nozzle means being movable along a path between operative and nonoperative positions, automatic means for positionally arranging said nozzle means relative to said needle means incident to machine actuation, said extendable/retractable nozzle means being capable of controllably and consistently directing a flow of cooling medium generally transverse to said path and against said sewing machine needle means while in its operative position.

15. The invention according to claim 14 wherein the movement of the extendable/retractable nozzle means has a horizontal component extending proximate to and crosswise of the reciprocal path of the needle means.

16. In combination with a sewing machine having reciprocal needle means defining a sewing area, a needle cooling apparatus comprising:

movably arranged nozzle means mounted and operated independently of any sewing machine moving part and maneuverable along a generally horizontal path in response to machine actuation between a first static position whereby said nozzle means controllably and continually directs a flow of cooling medium in a direction generally transverse to the path of said nozzle means and toward said needle means and a second retracted position providing operator access to the sewing area of the machine.

17. In a sewing machine having stitch forming devices including needle means reciprocal in a generally vertical path of travel, a needle cooling apparatus comprising:

air dispensing means telescopically distendable in a direction generally transverse to the path of the needle means and into the zone of operation of the needle means incident to operation of the machine for delivering a continuous stream of cooling air in a direction generally transverse to its distendable path against said needle means, said air dispensing means having a portion extending in front of and laterally across the reciprocal path of the needle means.

18. In combination with a sewing machine, a device for cooling the sewing machine needle comprising:

operative means capable of directing a flow of cooling medium from in front of and toward said needle means; and fluidically operable actuating means for moving said operative means along a linear path extending substantially transverse to the flow of cooling medium, said fluidically operable actuating means being constructed and arranged to automaticaiiy position and maintain said operative means along said path in a position substantially adjacent the path of the needle independent of movable sewing devices yet in timed sequence with machine actuation.

19. A device as in claim 18 wherein said cooling medium is compressed air.

20. A device for cooling the needle of a sewing machine comprising:

a pressure responsive pneumatic system effective upon operation of the machine and including means mounted independently of any movable sewing part for directing a stream of cooling medium toward said sewing machine needle along a first direction, said system being effective to positionally maneuver said directing means along a second direction between an inoperative position and a biasably movable operative position arranged adjacent said sewing machine needle and whereat a continuous stream of cooling medium is directed toward the needle, with said first and second directions extending diverse relative to one another.

21. A sewing machine needle cooling device comprising:

nozzle means operated and mounted independently of any sewing machine moving part for directing a flow of cooling medium against the sewing machine needle in a first direction;

means for causing linear movement of said nozzle means in a second direction extending transverse to said first direction from one of two dispositions to the other, said means for causing movement includes a pneumatically responsive component which, upon exposure thereof to a pressurized cooling medium, effects movement of said nozzle means from one of said dispositions to the other thereof; and operator controlled means for influencing the exposure of said component to said pressurized source of cooling medium.

* * * * *